United States Patent [19]

Moyer

[11] Patent Number: 4,621,457

[45] Date of Patent: Nov. 11, 1986

[54] INDEXED LAPPING MACHINE

[75] Inventor: Jesse R. Moyer, Kersey, Pa.

[73] Assignee: Exotic Metals, Inc., Ridgway, Pa.

[21] Appl. No.: 669,811

[22] Filed: Nov. 8, 1984

[51] Int. Cl.[4] ..... B24B 33/08

[52] U.S. Cl. ..... 51/59 R; 51/34 H

[58] Field of Search ..... 51/34 H, 165.74, 165.75, 51/165 R, 72 R, 34 C, 34 D, 34 J, 34 K, 59 R

[56] References Cited

U.S. PATENT DOCUMENTS

| | | | |
|---|---|---|---|
| 2,130,393 | 9/1938 | Johnson | 51/34 J |
| 2,318,837 | 5/1943 | Connor | 51/290 |
| 2,667,016 | 1/1954 | Seborg | 51/34 D |
| 2,765,529 | 10/1956 | Bolender | 29/558 |
| 2,982,254 | 5/1961 | Joelson | 173/52 |
| 3,042,326 | 7/1962 | Lamb | 242/26.3 |
| 3,161,992 | 12/1964 | Gentry et al. | 51/59 R |

*Primary Examiner*—Frederick R. Schmidt
*Assistant Examiner*—Maurina Rachuba
*Attorney, Agent, or Firm*—Edgar A. Zarins; Steven L. Permut

[57] ABSTRACT

An indexing lapping machine includes a drive piston mounted within a pneumatic cylinder which is reciprocated back and forth due to a pneumatic pressure action on the piston. The piston is connected to a rod which has a lapping tool connected thereto. An actuator rod is also fixed to the piston. The actuator rod has a camming member coaxially mounted thereon and frictionally slidable thereagainst. The camming member is interposed between an abutment member and a timer reset switch such that upon a downward stroke of the piston, the camming member abuts the abutment member and allows the actuator rod to slide the full extent of the piston stroke but during upward movement of the piston, the camming member rides with the actuator rod until the camming member abuts the reset switch which prevents the full raising of the piston and recycles the piston to the downward stroke.

13 Claims, 11 Drawing Figures

INDEXED LAPPING MACHINE

TECHNICAL FIELD

This invention relates to lapping machines and more particularly, to lapping machines that have an indexed stroking mechanism.

DISCLOSURE INFORMATION

Lapping splines, gears, and similar articles can be a time consuming and laborious process. A precision honing or lapping tool must repetitively slide against the part to be lapped. The tool must be pushed until friction stops it and retracted for a subsequent stroke. As such, various machines have been developed to automate the lapping process. U.S. Pat. No. 2,765,529 issued Oct. 9, 1956 to Bolender discloses a honing machine that is operated by hydraulic pressure acting upon a working piston. The machine also has a rotatable indexing operation which helps form uniform splines.

U.S. Pat. No. 2,318,837 issued May 11, 1943 to Connor discloses a honing machine which has abrasive stones which are loaded upon thrust pistons such that the force of the stone against the part to be honed is variable. A control rod and cam actuate the valve for creating pressure on the abrasive stone piston.

U.S. Pat. No. 2,982,254 issued on May 2, 1961 to Joelson discloses a pneumatic motor constructed to create vibrations. The motor has a tie rod mounted parallel to the working piston rod. Different tension springs can be mounted to adjust the amplitude and frequency of the piston stroke. A permanent hydraulic pressure source is applied to one side of the piston. The other side of the piston is adapted to be cyclically connected with the pressure source to actuate the piston.

U.S. Pat. No. 3,042,326 issued on July 3, 1962 to Lamb et al discloses a control mechanism having set collars mounted on a control rod parallel to the piston rod.

All conventional machines that reciprocate have the piston reciprocating through its full stroke. The piston is returned to its full retracted position before a subsequent stroke is started. As a result of this full extension and full retraction, the part which is to be lapped may undergo uneven lapping. The section of the part that is near the piston is lapped during each and every stroke while the section of the part that is farthest away from the piston undergoes lapping only near the end of the lapping process. Consequently, the section farthest away from the piston receives much fewer lap strokes than the nearer section. As a result, the nearer section may undergo unnecessary wear and hence, an unevenly lapped gear or spline may be produced.

What is needed is a lapping machine that laps the bottom section of a part approximately the same amount as the top section. In order to do this, an indexing of the stroke is needed such that the piston is not fully retracted but is merely retracted a predetermined amount above the full extension of the previous stroke.

SUMMARY OF THE INVENTION

In accordance with one aspect of the invention, a lapping machine has a piston and rod assembly, the rod being constructed to have a lapping tool mounted at an end thereof. The piston is operably connected through a pneumatic circuit. An electrical circuit controls the pneumatic circuit to extend the piston toward the object to be lapped for a predetermined amount of time. The pneumatic pressure determines the amount of force in each piston thrust. The electrical circuit also controls the piston to retract a predetermined distance from its extended position.

Preferably, an indexing mechanism includes a first camming member which is slidably mounted on the piston and rod assembly. A stationary abutment shoulder is constructed to abut the camming member and retain it in place after the piston and rod assembly extend toward the object a set distance. The piston slides with respect to the first camming member for the remainder of the thrust of the piston and rod assembly. A stationary switch is spaced from the abutment shoulder such that upon retraction of the piston and rod assembly, the first camming member is carried by the piston and rod assembly until the camming member abuts and actuates the stationary switch. The switch is operably connected to an electrical circuit which ceases further retraction of the piston and rod assembly. In addition, actuation of the stationary switch commences the subsequent thrust of the piston. Hence, the spacing of the stationary switch and abutment shoulder and the shuttling of the first camming member controls the stroke length of the piston and rod assembly. In one embodiment, the abutment shoulder or the switch is adjustably mounted to adjust the space therebetween such that the stroke length is easily adjustable.

In accordance with another aspect of the invention, a second camming member is fixed with respect to the piston and positioned such that upon a predetermined extension of the piston the second camming member actuates a stop switch which deactuates the lapping machine. Hence, the second camming member controls the depth of the lapping process. Preferably, one of the second camming members and the stop switch are also adjustable to adjust the maximum length therebetween thereby providing for an easily adjustable depth of the lapping operation before the machine automatically stops.

Preferably, each camming member is coaxially mounted about a guide rod that is affixedly connected to the piston. The depth stop camming member is fixedly and adjustably secured to the guide rod while the stroke length camming member is frictionally but slidably connected thereto.

Preferably, the pneumatic circuit applies a constant retracting pressure on one side of the piston and a cyclically variable operating pressure on the other side of the piston so that when the piston is actuated, the pressure on the other side exceeds the constant retracting pressure and extends the piston toward the object. During retraction of the piston, the pressure on the other side is decreased below the constant retracting pressure.

A broader aspect of the invention relates to a retraction device for a lapping machine that limits the retracting stroke of the lapping tool to a distance less than the fully retracted position thereof.

In this fashion, an automobile lapping machine reciprocates the lapping tool against the object to be lapped. The stroke of the lapping tool is indexed such that each section of the object receives approximately the same number of strokes. The indexing feature prevents excessive wear on the nearer portion of the lapped object. In this fashion, a more uniform lapping process is accomplished by an automated machine.

BRIEF DESCRIPTION OF THE DRAWINGS

Reference now will be made to the accompanying drawings in which.

DETAILED DESCRIPTION OF A PREFERRED EMBODIMENT

Figure 1:
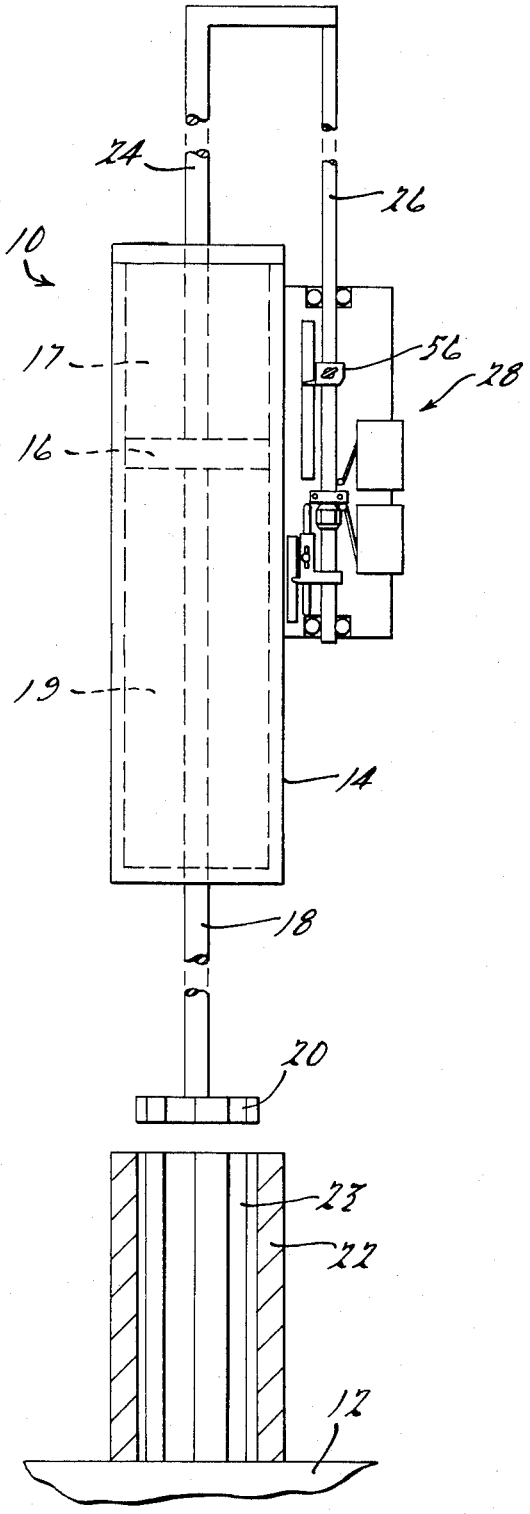
FIG. 1 is an elevational, schematic and fragmented view of an indexed lapping machine according to the invention.
Figure 3:
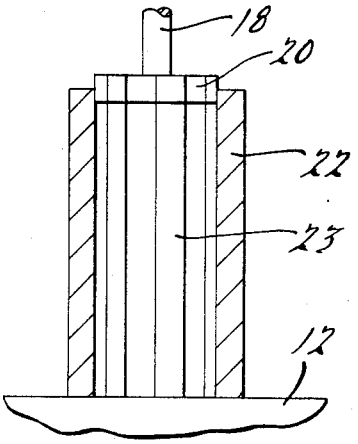
FIG. 3 is a view showing the object to be lapped and the lapping tool in a retracted position corresponding to the cam rack position in FIG. 2.

Referring to FIG. 1, an automatic lapping machine 10 includes a base 12 and a cylinder 14 fixedly mounted above the base 12. The cylinder 14 has a piston 16 mounted therein. The piston 16 divides the cylinder 14 into an upper section 17 and lower section 19. The piston 16 is connected to a downwardly extending rod 18 which can have a lapping tool 20 fixedly mounted thereto. The base 12 is constructed to secure an object 22 that is to be lapped by tool 20. An upwardly extending rod 24 also extends from piston 16 and is fixedly connected to a sliding rod 26 which extends through a cam rack assembly 28.

Figure 2:
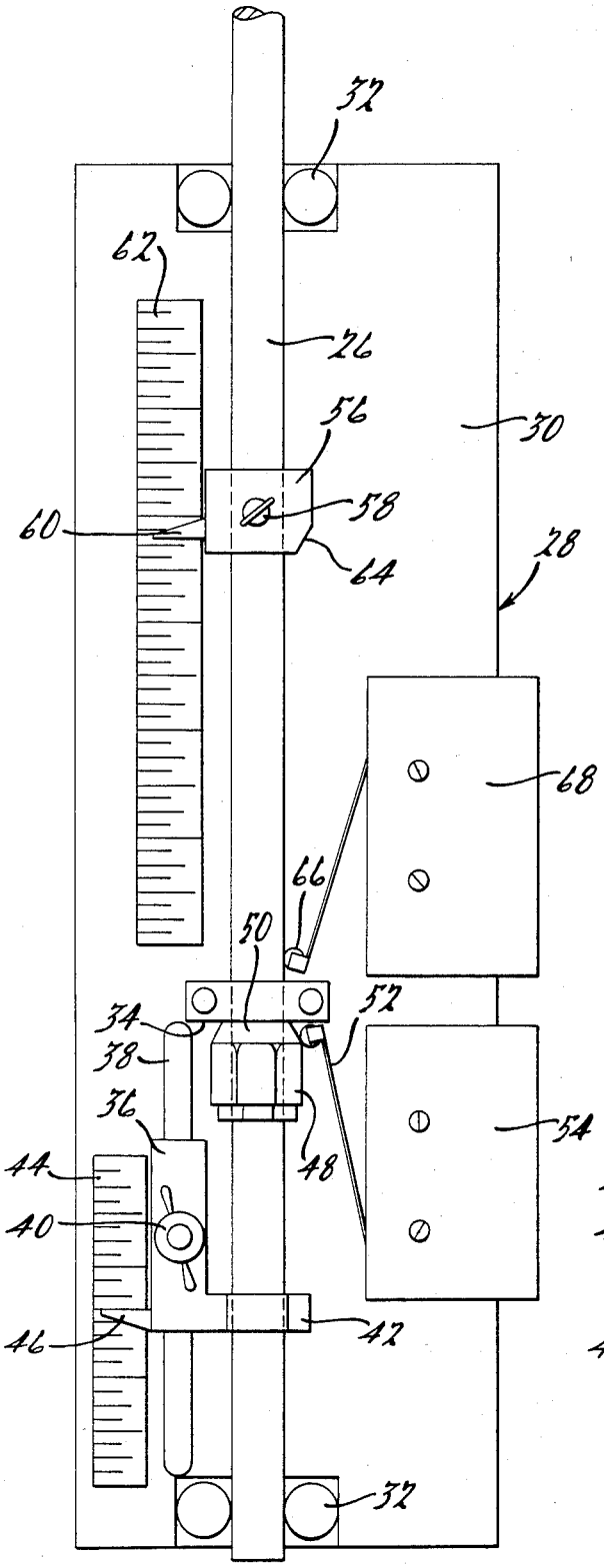
FIG. 2 is an enlarged fragmentary view more clearly showing the cam rack shown in FIG. 1 in the upper position.

Referring to FIG. 2, the cam rack assembly 28 has an indexing mechanism that includes a plate member 30 which is mounted onto cylinder 14. The two ends of the plate include bearing assemblies 32 which slidably mount the cam actuator rod 26.

An upper limit abutment member 34 is affixed to the plate 30 and receives cam actuator rod 26. A second lower limit abutment member 36 is adjustably fixed to plate member 30. The abutment member 36 can be adjustably fixed along mounting shaft 38 by the fastener mechanism 40. The lower abutment member 36 has an extension section 42 which slidably receives cam actuator rod 26. For convenience, a measurement scale 44 is affixed to plate 30 and lower limit abutment member 36 has a pointer 46. The scale 44 indicates the length of each indexed stroke of lapping tool 20.

A stroke length camming member 48 is coaxially mounted about cam actuator rod 26 between the upper abutment member 34 and lower abutment extension 42. The camming member 48 has frictional contact with the rod 26 such that the camming member 48 can be lifted by the rod 26 against the force of gravity and the upward acceleration of the rod 26 as shown in FIG. 2. The camming member 48 has an upper tapered section 50. A lever 52 of a timer reset switch 54 is positioned above the extension section such that it is actuated by the camming member 48 as shown in FIG. 2.

Figure 8:
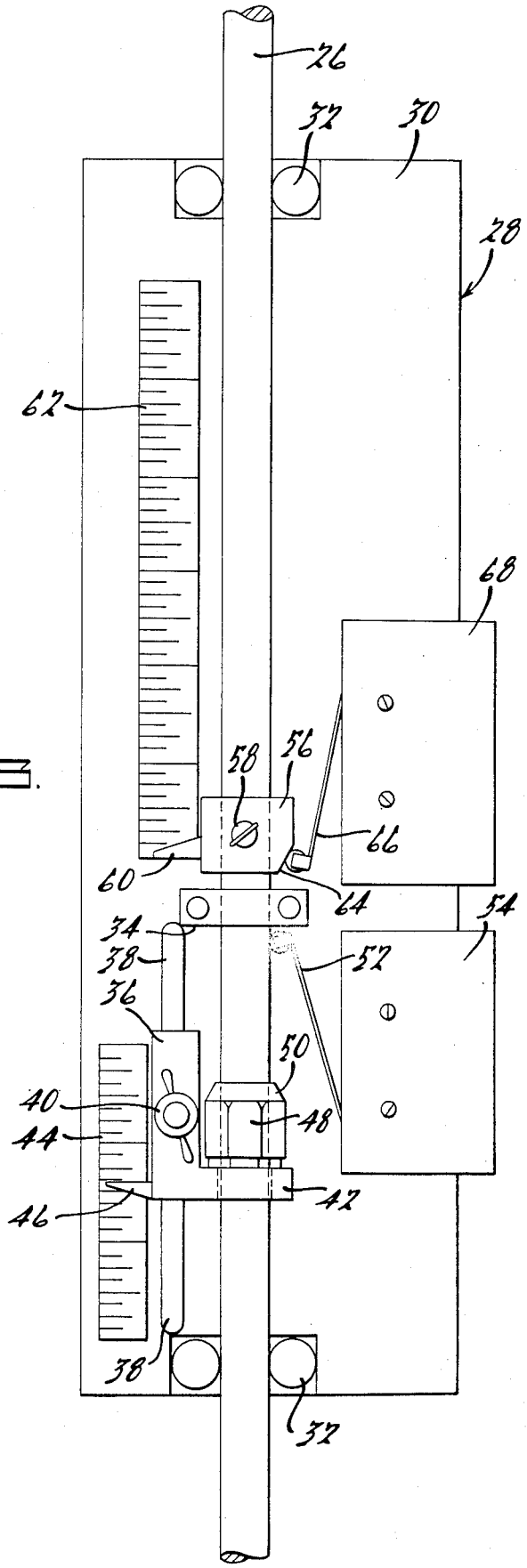
FIG. 8 is a view similar to FIG. 2 showing the cam rack in the shut-off position.

A depth stop camming member 56 is also coaxially mounted about the cam actuator rod 26. A set screw 58 adjustably fixes the depth stop camming member 56 onto the cam actuator rod 26. Tapered cam section 64 on camming member 56 abuts camming lever 66 of the depth stop switch 68 when lowered a sufficient amount as shown in FIG. 8. The camming member 56 also has a position indicator 60 which points along a measuring scale 62 that indicates the total depth which the lapping tool extends before the machine automatically shuts off. Because the depth stop camming member is adjustably fixed, the depth of the lapping operation is consequently adjustable.

Operation of the device can now be made with reference to FIGS. 1–9. Before the automatic lapping machine is actuated, the depth stop camming member 56 is adjusted to coincide with either the length of the hole 23 within the object 22 or to coincide with the height of the base table 12 (i.e. the bottom of object 22). The object 22 is placed on the base table 12 and an appropriate clamping mechanism (not shown) retains the object 22 in a stationary position. An appropriate lapping tool 20 is secured onto the end of the rod 18. The object 22 with internal splines and a male lapping tool 20 are illustrated. However, a female lapping tool 20 can also be attached to rod 18 for use with an externally splined object.

Figure 5:
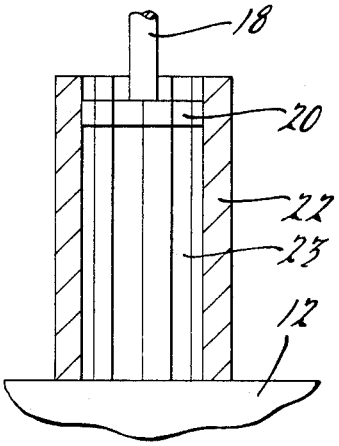
FIG 5 is a view similar to FIG. 3 showing the lapping tool in an extended position within the object to be lapped corresponding to the cam rack position in FIG. 4.

After the lapping machine is turned on, pneumatic pressure is applied as described in more detail later to both upper and lower sections 17 and 19 of cylinder 14. A greater pressure is applied to upper section 17 such that the piston 16 is forced downwardly. The cam actuator rod 26 also moves downwardly and moves the camming member 48 downwardly from the position shown in FIG. 2 to the position shown in FIG. 4. Once the camming member 48 abuts fixed extension 42, any further downward motion of rod 26 causes sliding of the camming member 48 along the rod 26. The piston 16 is forced downwardly until the friction between the object 22 and the lapping tool 20 overcomes the pneumatic pressure applied on the piston 16 whereby the tool 20 becomes stationary as shown in FIG. 5. After a predetermined amount of time, the pressure in upper section 17 is relieved and the pressure in section 19 drives the piston 16 upwardly.

Figure 4:
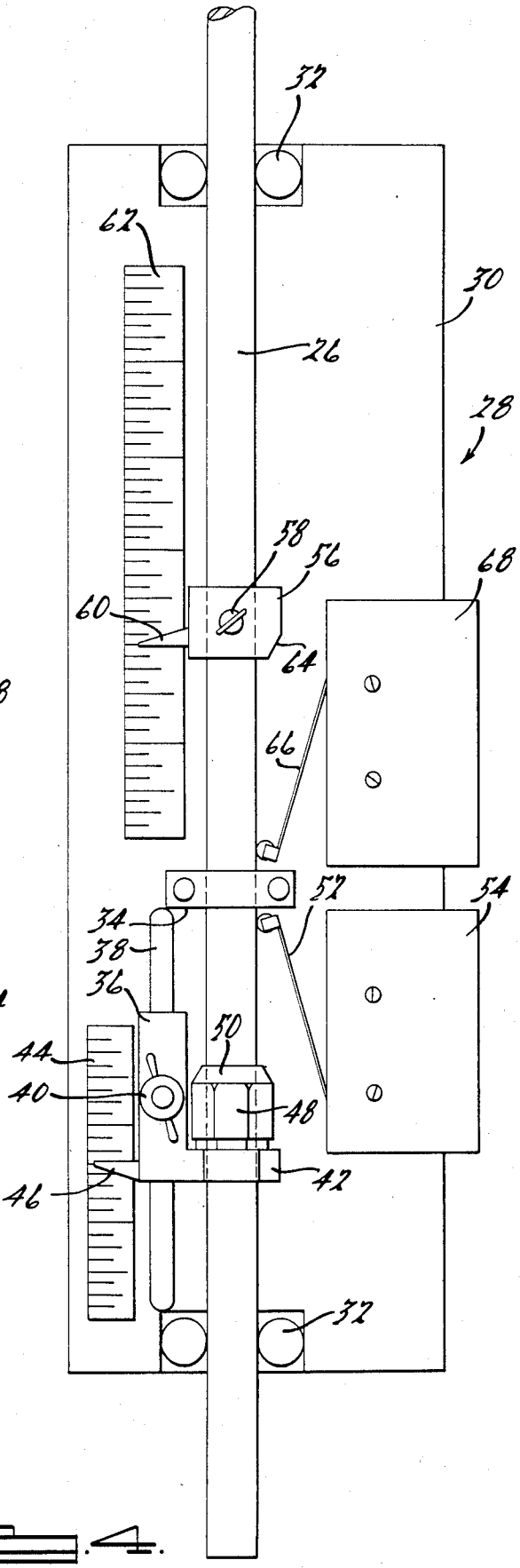
FIG. 4 is a view similar to FIG. 2 showing the cam rack in an extended position.

As the piston 16 is driven upwardly, the cam actuator rod 26 also moves upwardly carrying along the frictionally engaged camming member 48 from the position shown in FIG. 4 back to the position shown in FIG. 2 where it presses the lever 52 of timer reset switch 54. Actuation of timer reset switch 54 stops any further upward movement of the piston 16 and commences the next downward stroke. The distance travelled by the camming member 48 determines the upward stroke length of the piston and of the lapping tool 20 so that the lapping tool alternates between the position shown in FIG. 3 to the postion shown in FIG. 5.

Figure 6:
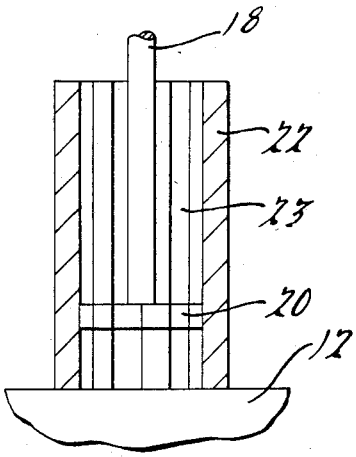
FIGS. 6 and 7 are views similar to FIGS. 3 and 5 showing the lapping tool in a retracted position and extended position respectively after partial completion of the lapping process.
Figure 7:
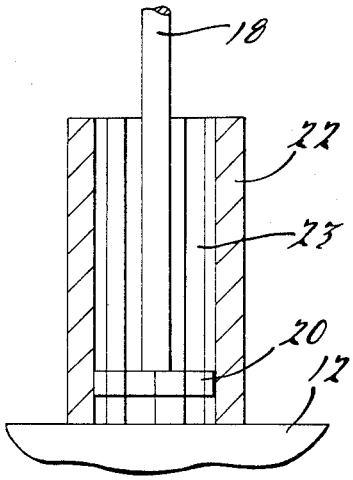
Figure 9:
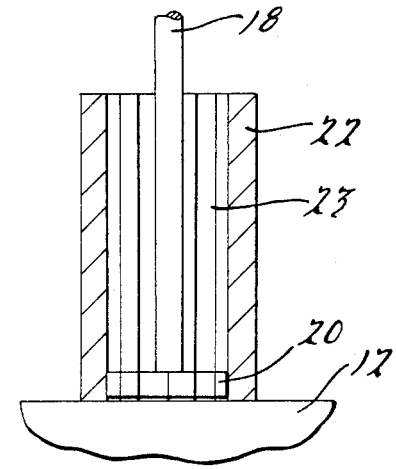
FIG. 9 is a view similar to FIG. 3 showing the lapping tool fully extended through the object.
Figure 10:
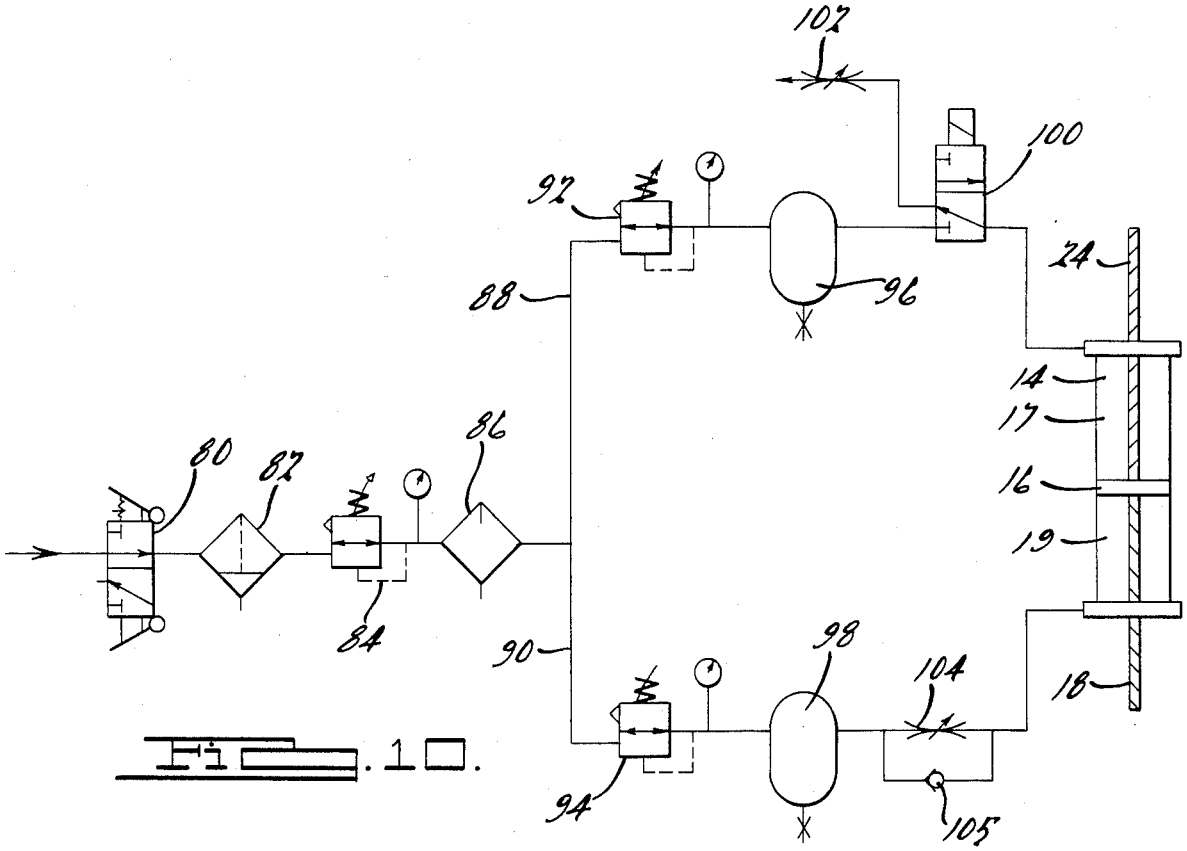
FIG. 10 is a schematic view of the pneumatic circuit which controls the movement of the piston.

As the bore 23 is smoothed out, the lapping tool slowly works its way toward the bottom as shown in FIGS. 6 and 7. As shown in FIG. 6, the lapping tool is in an upper position corresponding to FIG. 2 where the cam adjustment member 48 limits the upward movement of the piston 16 and lapping tool 20. As shown in FIG. 7, the lapping tool 20 then goes downwardly until it is frictionally engaged within bore 23 of the object 22 and will repeatedly then be retracted up to the position shown in FIG. 6. As the frictional impediments slowly give way, the lapping tool 20 further moves downward until it reaches the position shown in FIG. 9. In FIG. 9, the lapping tool has completed the lapping process. In this position, the depth stop cam 56 abuts the lever 66 of the depth stop switch 68 as shown in FIG. 8 which deactuates the lapping machine. The pneumatic circuit for the automatic lapping machine is schematically shown in FIG. 10. A manual three-way valve 80 is connected to an air supply (not shown). Downstream from a valve 80 is a filter 82, a pressure regulator 84, and an oiler 86. The pneumatic circuit then branches into two sections 88 and 90. The upper section 88 has a thrust pressure regulator 92 and the lower section 90 has a withdrawal pressure regulator 94. The thrust pressure regulator is set for a higher pressure than the withdrawal pressure regulator 94. The pressure regulators 92 and 94 are connected then to pressure accumulators 96 and 98 respectively. Downstream from accumulator 96 is a three way solenoid valve 100 normally positioned such that the accumulator 96 is shut off from cylinder section 17. In this position, the upper section 17 of cylinder 14 is in line with a flow control valve 102 which regulates the bleeding of the pressure from the cylinder section 17 and thus controls the speed of retraction of the piston. Accumulator 98 is in line with a check valve 105 and a flow control valve 104. The check control valve 105 allows for free flow of air into the lower section 19 of cylinder 14. The flow control valve 104 controls the flow of air from cylinder section 19 to accumulator 98 and consequently controls the speed of the downward stroke of piston 16.

When the solenoid 100 is in the position shown, air flows from the accumulator 98 into the cylinder section 19 while simultaneously air bleeds from cylinder 17 through the valve 102. In this fashion, the piston 16 is moved upwardly in a controlled fashion. Contrarywise, when the solenoid valve 100 is actuated, the pressure from accumulator 96 is in communication with the upper section 17 of cylinder 14. Since this pressure is greater than the pressure in the lower section, the piston is driven downwardly in a controlled fashion since the air in cylinder section 19 must back up through the flow control valve 104 into accumulator 98.

Figure 11:
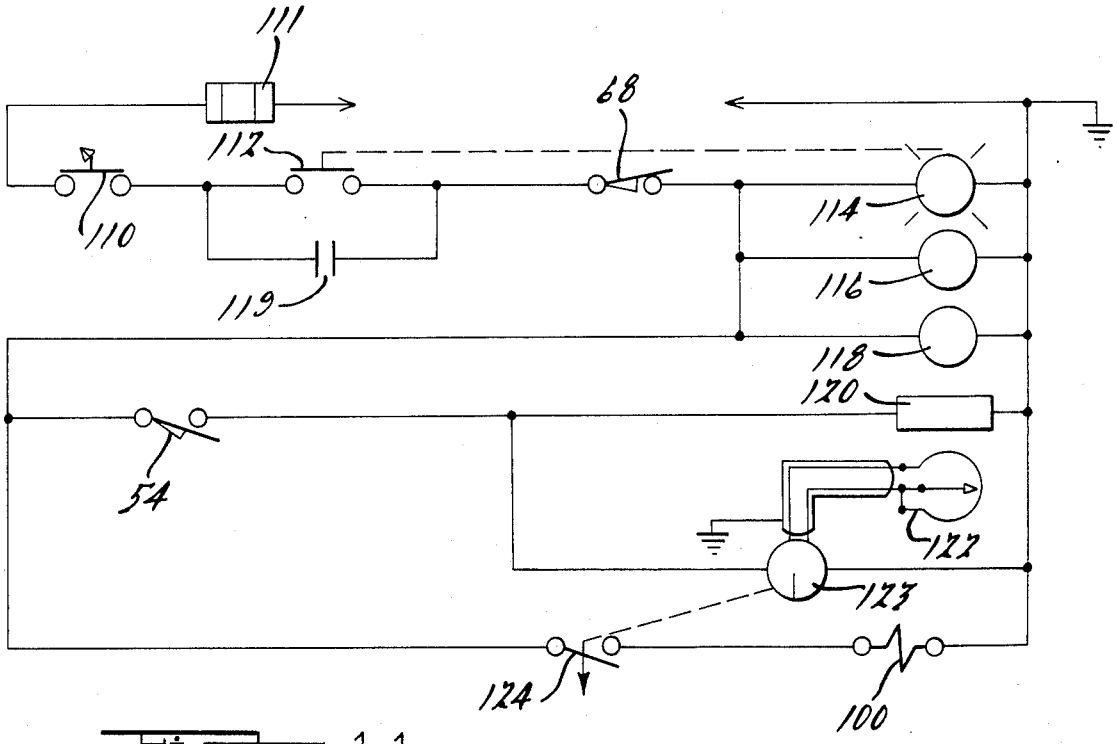
FIG. 11 is a schematic view of the electrical control circuitry.

Solenoid valve 100 is controlled by an electrical circuit that is shown in FIG. 11. The electrical circuit has a fuse 111 connected to a power source (not shown) and also to a main power switch 110. Downline from the switch 110 is a contact relay switch 112 which is associated with a button and light combination 114. In line with the contact relay 112 is a depth stop limit switch 68 which is normally in the closed position. Parallel to the contact relay is an hour timer 116 and the contact relay energizing coil 118 which closes contact 119 when energized. Depression of the button and light combination 114 temporarily closes switch 112 so that coil 118 is actuated. Contacts 119 then are permanently closed so that the switch 112 can then be released.

Reset switch 54 is normally open in the circuit. When reset switch 54 is closed, the cycle counter 120 records a cycle and an advanced dwell timer relay 123 controlling switch 124 and connected to a remote potentiometer 122 is actuated. The advanced dwell timer 123 can be an Eagle timer CG310A6-02. The remote potentiometer 122 can be an Eagle signal timer CG30071. The remote potentiometer 122 controls the length of time the relay 123 is activated and switch 124 is closed after the switch 54 reopens. The closure of switch 124 actuates the solenoid valve 100 and in turn controls the pneumatic circuit shown in FIG. 10. When the predetermined amount of time has passed, the switch 124 reopens which deactuates the valve 100 which allows the piston to retract until the camming member 48 recloses switch 54 at which time the cycle is sequentially repeated until the depth stop camming member opens switch 68 which deactuates the lapping machine and fully retracts the piston 16.

In this fashion, an adjustably predetermined upward stroke length is maintained as lapping progresses. The indexing of the lapping mechanism is achieved by the introduction of camming member 48 inserted between lower abutment member 36 and reset switch lever 52. Furthermore, the reciprocating and indexed lapping motion continues automatically until the depth stop switch is tripped by the camming member 56 at which time the valve circuits allow the drive piston 16 to return to a fully raised position and ready for a next lapping cycle.

Variations and modifications of the present invention are possible without departing from the scope and spirit as defined in the appended claims.

The embodiments of the invention in which an exclusive property or privilege is claimed are defined as follows:

1. A lapping machine characterized by:

a housing defining a cylinder;

a piston operably mounted within said cylinder;

a rod fixed to said piston forming a piston and rod assembly and constructed to be connectable to a lapping tool;

actuating means for thrusting said piston toward an object to be lapped by said lapping tool with a predetermined force and a predetermined time until friction overcomes said thrusting when said piston is in a thrusted position; and retracting means for retracting said piston a predetermined distance from its thrusted position, said retracting means including a stroke length camming member movably connected onto said piston and rod assembly for indexing said thrusting and retracting of said piston to variably limit the predetermined distance said piston is retracted from its thrusted position with each thrust of said piston and rod assembly, a stationary abutment shoulder adapted to abut said stroke length camming member and retain it in place after said piston is thrusted toward said object a set distance, and a switch means for ceasing further retraction of said piston and rod assembly.

2. A lapping machine as defined in claim 1 wherein said switch means includes:

a switch fixedly mounted to said housing and being spaced from said abutment shoulder such that upon retraction of said piston, said stroke length camming member moves with said piston and actuates said switch after movement of a predetermined amount.

3. A lapping machine as defined in claim 2 wherein:

said switch is operably connected to said actuating means to commence a subsequent thrust of said piston.

4. A lapping machine as defined in claim 2 wherein:

one of said abutment shoulder and said switch is adjustably mounted to adjust the space therebetween.

5. A lapping machine as defined in claim 2 further characterized by:

a depth stop camming member connected to said piston and positioned such that when said piston extends a certain distance said cam abuts and actuates a stop switch which deactuates said lapping machine.

6. A lapping machine as defined in claim 5 wherein:

one of said depth stop cam member and said stop switch being adjustably fixed to adjustably preselect the thrust length of said piston before said depth stop camming member abuts said stop switch.

7. A lapping machine as defined in claim 2 wherein:

said stroke length camming member is coaxial and slidably mounted about a rod that is fixedly connected to said piston.

8. A lapping machine as defined in claim 2 wherein:

said piston has a constant retracting pressure exerted on one side and a variable extension pressure exerted on its other side;

said actuating means causing said pressure on said other side to increase above said retracting pressure; and said retracting means causing said pressure on said other side to decrease below said retracting pressure.

9. A lapping machine as defined in claim 1 wherein:

said piston has a constant retracting pressure exerted on one side and a variable extension pressure exerted on its other side;

said actuating means causing said pressure on said other side to increase above said retracting pressure; and said retracting means causing said pressure on said other side to decrease below said retracting pressure.

10. A lapping machine characterized by:

a lapping tool constructed to lap the length of an object to be lapped;

actuating means for thrusting said lapping tool toward said object with a predetermined force for a predetermined amount of time;

retracting means for retracting said lapping tool a predetermined amount from its position caused by said actuating means; and limiting means for variably limiting the predetermined amount said lapping tool is retracted from said object with each thrust of said lapping tool toward said object.

11. A lapping machine characterized by:

a housing;

a carrier member movably mounted with respect to said housing;

said carrier member constructed to be connectable to a lapping tool;

actuating means for forcibly thrusting said carrier member toward an object to be lapped by said lapping tool until friction overcomes said thrusting when said carrier member is in a thrusted position; and retracting means for retracting said carrier a predetermined distance from its thrusted position, said retracting means including:

a stroke length indexing member movably mounted to said carrier member;

a stationary abutment shoulder constructed to abut said stroke length indexing member and retain it in place after said carrier member moves toward said object a set distance and to allow said carrier member to move with respect to said indexing member for the remainder of the thrusting of said carrier member; and switch means being mounted to said lapping machine and having means for actuating when said indexing member is moved a predetermined distance from said abutment shoulder during retraction of said carrier member for ceasing further retraction thereof.

12. A lapping machine as defined in claim 11 wherein:

said switch means is operably connected to said actuating means to commence a subsequent thrust of said carrier member.

13. A lapping machine as defined in claim 11 further comprising:

a depth stop switch means being mounted to said lapping machine and being actuated when said carrier member extends a predetermined distance for ceasing further operation of said lapping machine.

* * * * *